US006318143B1

(12) United States Patent
Mustread et al.

(10) Patent No.: US 6,318,143 B1
(45) Date of Patent: Nov. 20, 2001

(54) APPARATUS FOR PRODUCING A VEHICLE WHEEL RIM

(75) Inventors: Larry Mustread; John W. Penrod, both of Bowling Green; Danny C. Vincent, Sweeden, all of KY (US)

(73) Assignee: Hayes Lemmerz International, Inc., Northville, MI (US)

( * ) Notice: Subject to any disclaimer, the term of this patent is extended or adjusted under 35 U.S.C. 154(b) by 0 days.

(21) Appl. No.: 09/578,134

(22) Filed: May 24, 2000

(51) Int. Cl.[7] ..... B21D 53/30
(52) U.S. Cl. ..... 72/393; 72/353.4
(58) Field of Search ..... 72/353.4, 353.6, 72/393, 448

(56) References Cited

U.S. PATENT DOCUMENTS

| | | | | |
|---|---|---|---|---|
| 2,720,241 | * | 10/1955 | Calcaterra | 72/393 |
| 3,298,218 | * | 1/1967 | Gollwitzer | 72/393 |
| 3,575,035 | | 4/1971 | Nokes . | |
| 3,706,120 | | 12/1972 | Bulgrin . | |
| 4,985,993 | | 1/1991 | Yagi et al. . | |
| 5,010,759 | | 4/1991 | Yokomizo et al. . | |
| 5,257,569 | | 11/1993 | Santarossa . | |
| 5,579,578 | | 12/1996 | Ashley, Jr. . | |

FOREIGN PATENT DOCUMENTS

| | | |
|---|---|---|
| 42 06 500 | 11/1992 | (DE) . |
| 632325 | 11/1949 | (GB) . |
| 00 40349 | 7/2000 | (WO) . |

* cited by examiner

*Primary Examiner*—Lowell A. Larson
(74) *Attorney, Agent, or Firm*—MacMillan, Sobanski & Todd, LLC

(57) ABSTRACT

An improved wheel rim expanding tooling apparatus includes an inboard wheel rim expanding tooling assembly and an outboard wheel rim expanding tooling assembly which are selectively moveable between a retracted non-working position and an extended working position. The inboard wheel rim expanding tooling assembly includes an inboard expander press, an inboard barrel head, and a pair of inboard expander press guide supports. Each of the pair of inboard expander press guide supports includes a base plate, an inboard barrel head support bracket, and a pair of runners. The base plate includes a pair of spaced apart rails, and the inboard barrel head support brackets includes a main body having a pair of spaced apart mounting legs extending therefrom. The main body defines a generally U-shaped cradle having a plurality of apertures formed therethrough which receive a fastener to thereby secure the inboard barrel head thereto. The runners are secured to the mounting legs by appropriate members. The outboard wheel rim expanding tooling assembly includes an outboard expander press, an outboard barrel head, and a pair of outboard expander press guide supports. Each of the pair of outboard expander press guide supports includes a base plate, an outboard barrel head support bracket, and a pair of runners. The base plate includes a pair of spaced apart rails, and the outboard barrel head support brackets includes a main body having a pair of spaced apart mounting legs extending therefrom. The main body defines a generally U-shaped cradle having a plurality of apertures formed therethrough which receive a fastener to thereby secure the outboard barrel head thereto. The runners are secured to the mounting legs by appropriate members.

16 Claims, 10 Drawing Sheets

APPARATUS FOR PRODUCING A VEHICLE WHEEL RIM

BACKGROUND OF THE INVENTION

This invention relates in general to vehicle wheels and in particular to an improved method and apparatus for producing a vehicle wheel.

A conventional vehicle wheel is typically of a two-piece construction and includes an inner wheel disc and an outer "full" wheel rim. The wheel disc can be cast, forged, or fabricated from steel, aluminum, or other alloys, and includes an inner annular wheel mounting portion and an outer annular portion. The wheel mounting portion of the wheel disc defines an inboard mounting surface and includes a center pilot or hub hole, and a plurality of lug receiving holes formed therethrough for mounting the vehicle wheel to an axle of the vehicle. The wheel rim is fabricated from steel, aluminum, or other alloys, and includes an inboard tire bead seat retaining flange, an inboard tire bead seat, an axially extending well, an outboard tire bead seat, and an outboard tire bead seat retaining flange. In some instances, a three-piece wheel construction having a mounting cup secured to the wheel disc is used. In both types of constructions, the outer annular portion of the wheel disc is secured to the wheel rim by welding.

A full face vehicle wheel is distinguished from other types of wheels by having a one-piece wheel disc construction. In particular, the full face wheel includes a "full face" wheel disc and a "partial" rim. The full face wheel disc can be cast, forged, or fabricated from steel, aluminum, or other alloys. The full face wheel disc includes an inner annular wheel mounting portion and an outer annular portion which defines at least a portion of an outboard tire bead seat retaining flange of the wheel. The wheel mounting portion defines an inboard mounting surface and includes a center pilot or hub hole, and a plurality of lug receiving holes formed therethrough for mounting the wheel to an axle of the vehicle. The partial wheel rim is fabricated from steel, aluminum, or other alloys, and includes an inboard tire bead seat retaining flange, an inboard tire bead seat, an axially extending well, and an outboard tire bead seat. In some instances, the outboard tire bead seat of the wheel rim and the outer annular portion of the wheel disc cooperate to form the outboard tire bead seat retaining flange of the full face wheel. In both types of constructions, the outboard tire bead seat of the wheel rim is positioned adjacent the outer annular portion of the wheel disc and a weld is applied to join the wheel rim and the wheel disc together.

In the above wheel constructions, the wheel rim of the associated vehicle wheel is typically subjected to a final expanding operation to produce a finished wheel rim having a desired final profile prior to securing the wheel rim to the wheel disc by welding. A typical sequence of steps which can be used to produce a full wheel rim for use in a conventional type of vehicle wheel is disclosed in U.S. Pat. No. 4,185,370 to Evans. As shown in this patent, the method includes the steps of: (a) providing a flat sheet of suitable material, such as aluminum or steel; (b) forming the sheet into a cylindrical hoop or band; (c) flaring the lateral edges of the hoop radially outwardly to produce a rim preform having flanges suitable for positioning on a roll forming machine; (d) subjecting the rim preform to a series of roll forming operations to produce a wheel rim having a predetermined shape; and (e) expanding the wheel rim to a produce a finished wheel rim having a predetermined circumference. A sequence of steps which can be used to produce a partial wheel rim for use in a full face type of vehicle wheel is disclosed in U.S. Pat. No. 5,579,578 to Ashley, Jr.

SUMMARY OF THE INVENTION

This invention relates an improved wheel rim expanding tooling apparatus for producing a vehicle wheel rim. The wheel rim expanding tooling apparatus includes an inboard wheel rim expanding tooling assembly and an outboard wheel rim expanding tooling assembly which are selectively moveable between a retracted non-working position and an extended working position. The inboard wheel rim expanding tooling assembly includes an inboard expander press, an inboard barrel head, and a pair of inboard expander press guide supports. Each of the pair of inboard expander press guide supports includes a base plate, an inboard barrel head support bracket, and a pair of runners. The base plate includes a pair of spaced apart rails, and the inboard barrel head support brackets includes a main body having a pair of spaced apart mounting legs extending therefrom. The main body defines a generally U-shaped cradle having a plurality of apertures formed therethrough which receive a fastener to thereby secure the inboard barrel head thereto. The runners are secured to the mounting legs by appropriate members. The outboard wheel rim expanding tooling assembly includes an outboard expander press, an outboard barrel head, and a pair of outboard expander press guide supports. Each of the pair of outboard expander press guide supports includes a base plate, an outboard barrel head support bracket, and a pair of runners. The base plate includes a pair of spaced apart rails, and the outboard barrel head support brackets includes a main body having a pair of spaced apart mounting legs extending therefrom. The main body defines a generally U-shaped cradle having a plurality of apertures formed therethrough which receive a fastener to thereby secure the outboard barrel head thereto. The runners are secured to the mounting legs by appropriate members. The wheel rim expanding tooling apparatus of the present invention is operative to provide a support and guidance system which keeps the inboard wheel rim expanding tooling assembly and the outboard wheel rim expanding tooling assembly substantially parallel to one another and with respect to an axis of the wheel rim during movement thereof throughout the expanding operation. As a result, the uniformity of the resulting wheel rim is improved.

Other advantages of this invention will become apparent to those skilled in the art from the following detailed description of the preferred embodiments, when read in light of the accompanying drawings.

DESCRIPTION OF THE PREFERRED EMBODIMENTS

Figure 1:
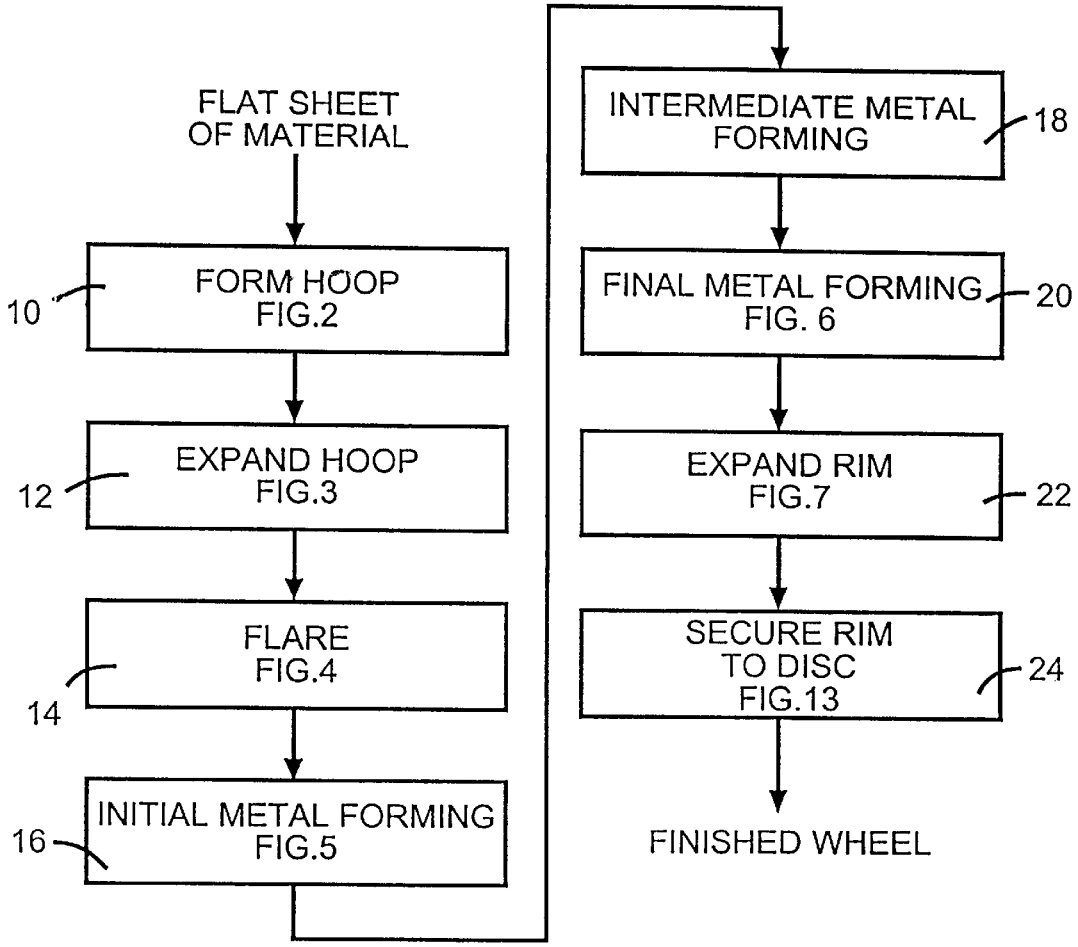
FIG. 1 is a block diagram showing a sequence of steps for producing a wheel rim for use in a vehicle wheel in accordance with the present invention.
Figure 13:
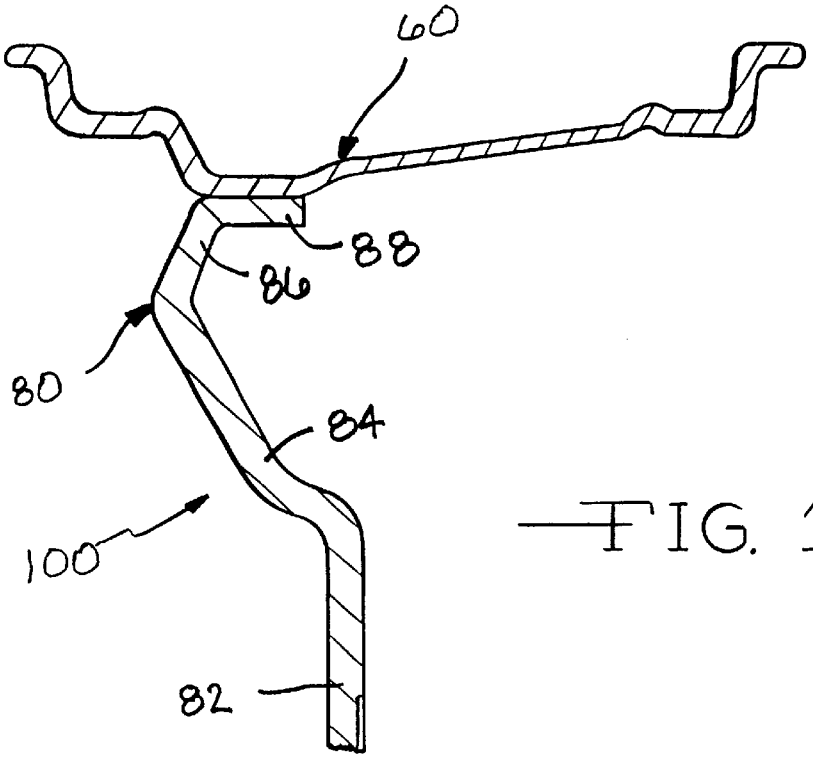
FIG. 13 is a partial sectional view of a first embodiment of a vehicle wheel constructed using a wheel rim produced using the wheel rim expanding tooling apparatus in accordance with the present invention.

Referring now to the drawings, there is illustrated in FIG. 1 a block diagram showing a sequence of steps for producing a first embodiment of a vehicle wheel 100, such as shown in FIG. 13, and which incorporates a first embodiment of a wheel rim, indicated generally at 60 and constructed in accordance with this invention. As shown in this embodiment, the vehicle wheel 100 is a well attached vehicle wheel. While the present invention will be described and illustrated in connection with the particular vehicle wheels disclosed herein, it is understood that the invention can be used to produce a wheel rim for use in constructing other types of vehicle wheels if so desired.

Figure 2:
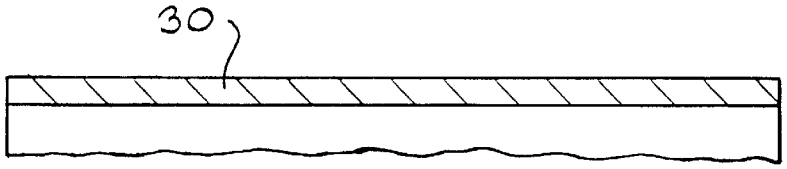
FIG. 2 is a schematic diagram of a wheel rim blank being formed into a hoop.
Figure 3:
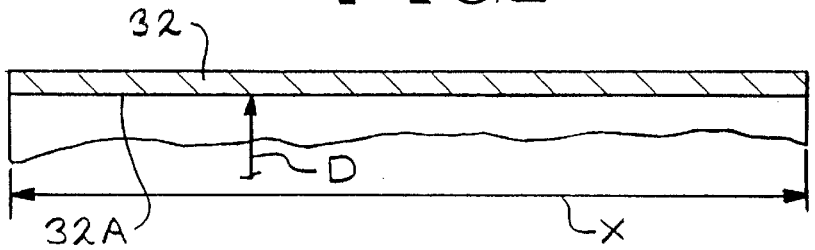
FIG. 3 is a schematic diagram of the hoop after an expanding operation.
Figure 4:
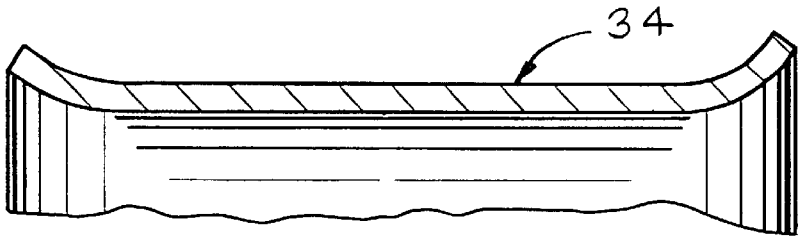
FIG. 4 is a schematic diagram of a wheel rim preform produced by a flaring operation.
Figure 5:
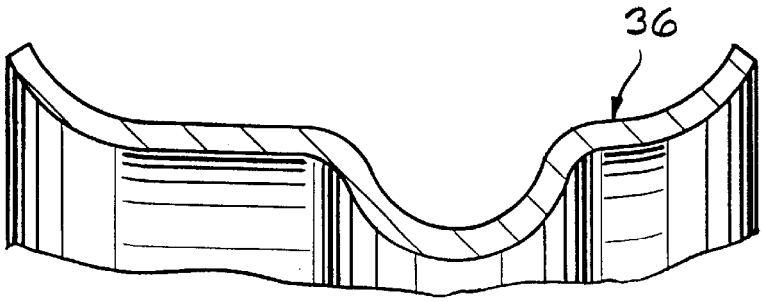
FIG. 5 is a schematic diagram of a partially-shaped wheel rim produced by an initial metal forming operation.
Figure 6:
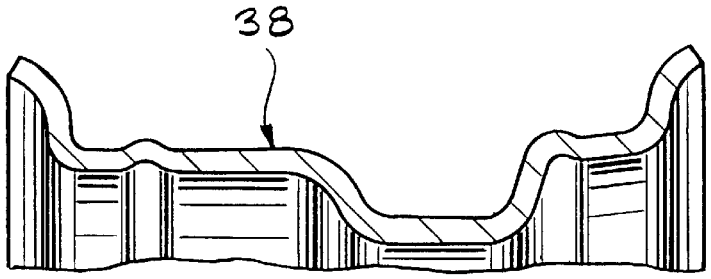
FIG. 6 is a schematic diagram of the partially-shaped wheel rim produced by a final metal forming operation.

Initially in step 10, a flat sheet of suitable material, such as for example, steel, aluminum, alloys thereof, is formed into a generally cylindrical hoop or band and welded to produce the hoop 30 shown in FIG. 2. When the hoop 30 is welded in step 10, a flat surface (not shown) is typically created by the weld. As a result of this, the hoop 30 is expanded in step 12 to produce a substantially cylindrical hoop 32 shown in FIG. 3. The hoop 32 extends a predetermined axial length X and includes an inner surface 32A which defines a predetermined inner diameter D thereof. Next, in step 14, the opposed ends of the hoop 32 are flared upwardly as to produce a wheel rim preform 34 shown in FIG. 4. Following this, in steps 16, 18, and 20, the wheel rim preform 34 is subjected to a series of metal forming operations to progressively produce wheel rims 36 and 38 (initial metal forming step 16 is operative to produce wheel rim 36 as shown in FIG. 5, and final metal forming step 20 which is operative to produce wheel rim 38 as shown in FIG. 6). Preferably, the metal forming operations of steps 16, 18, and 20 include subjecting the wheel rim preform 34 to a series of roll forming operations since tighter tolerances can be maintained in the wheel rim 60. Alternatively, other metal deforming operations can be used in one or more of the steps 16, 18, and 20 to progressively produce the wheel rim 60. For example, the wheel rim preform 34 can be subjected to forward or reverse flow spinning operations, pressing operations, or any suitable combinations of roll forming, flow spinning, and pressing operations which are operative to cause deformation, reshaping, and/or thinning of the metal to produce a variable thickness wheel rim having 60 having a desired profile.

Next, in step 22 and referring to FIGS. 8–12, the wheel rim 38 is expanded to produce the finished wheel rim 60 in accordance with the present invention. To accomplish this, the wheel rim 38 is supported in the position shown in FIG. 10 by conventional means (not shown) to enable the wheel rim 38 to be processed in accordance with a first embodiment of a vehicle wheel rim expanding tooling apparatus, indicated generally at 110, of the present invention. The general structure and operation of the wheel rim expanding tooling apparatus 110 is conventional in the art. Thus, only those portions of the wheel rim expanding tooling apparatus 110 which are necessary for a full understanding of this invention will be explained and illustrated in detail.

Figure 8:
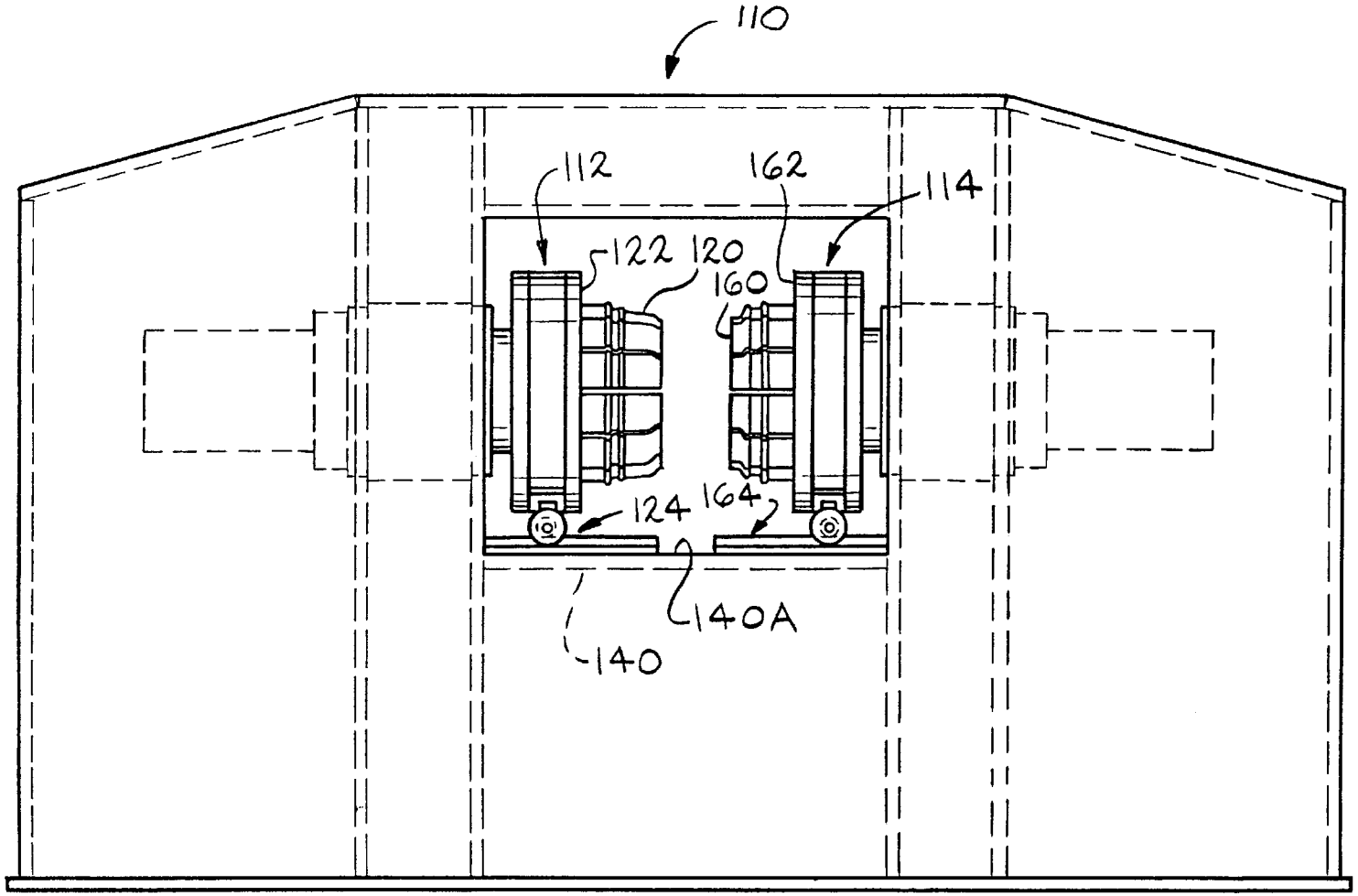
FIG. 8 is an elevational view of a first embodiment of a wheel rim expanding tooling apparatus in accordance with the present invention, with the wheel rim expanding tooling apparatus being shown in an intermediate or semi-extended working position.
Figure 9:
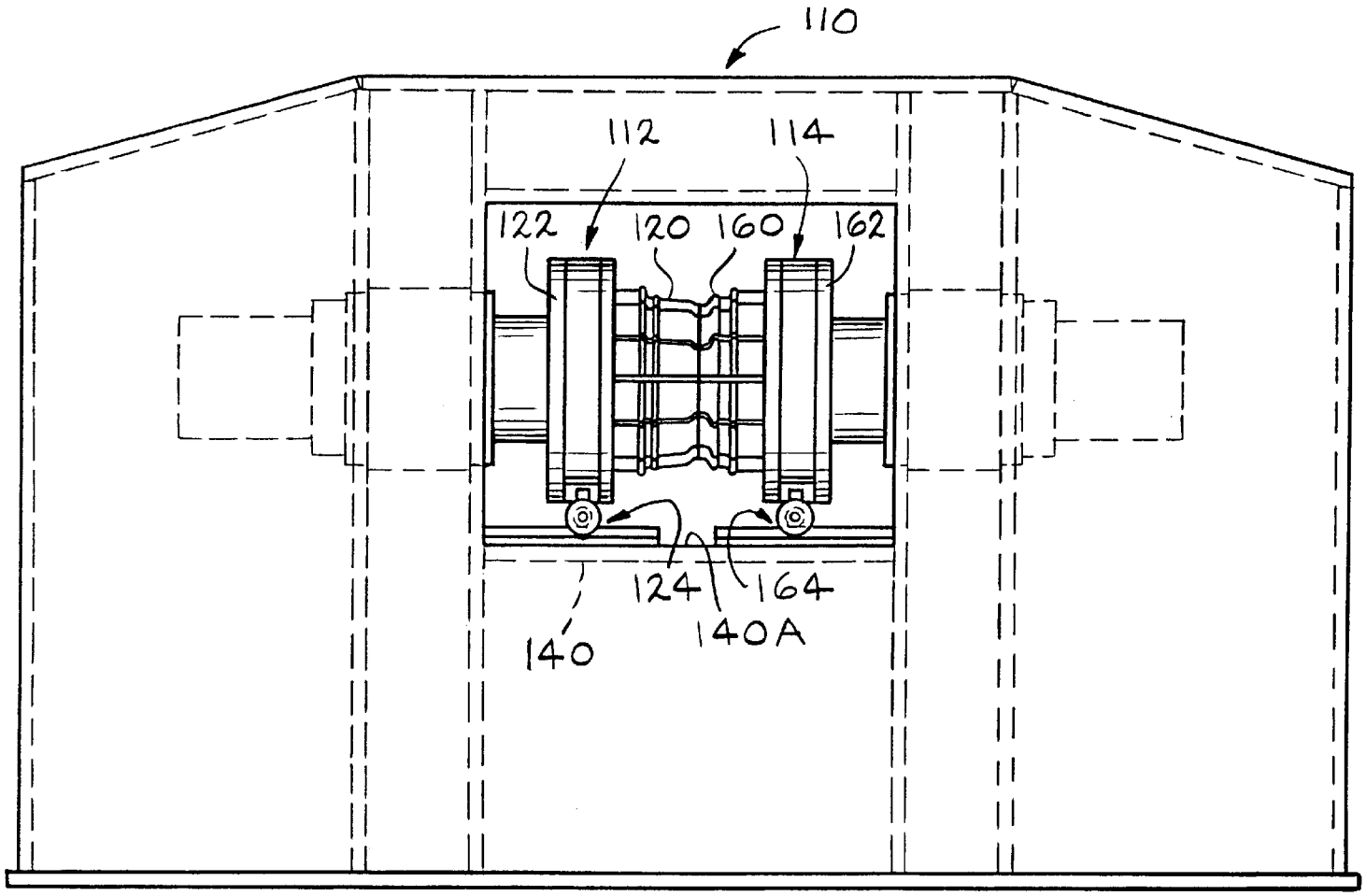
FIG. 9 is an elevational view similar to FIG. 8 and showing the wheel rim expanding tooling apparatus being shown in a final working or fully extended position.
Figure 10:
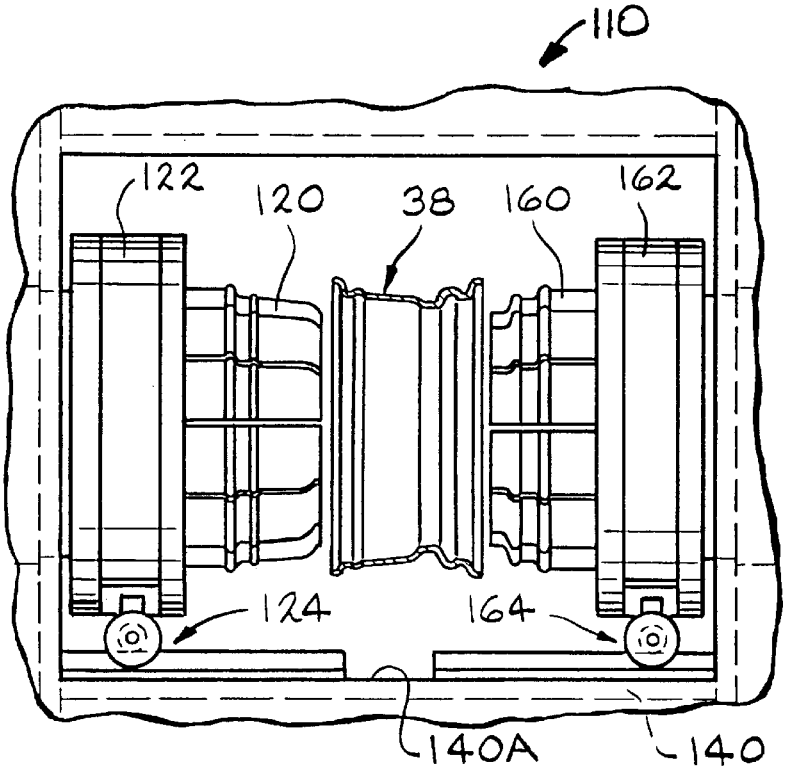
FIG. 10 is a partial elevational view of the wheel rim expanding tooling apparatus illustrated in FIGS. 8 and 9 and showing a wheel rim adapted for use therewith, the wheel rim expanding tooling apparatus being shown in a non-working or fully retracted position.
Figure 11:
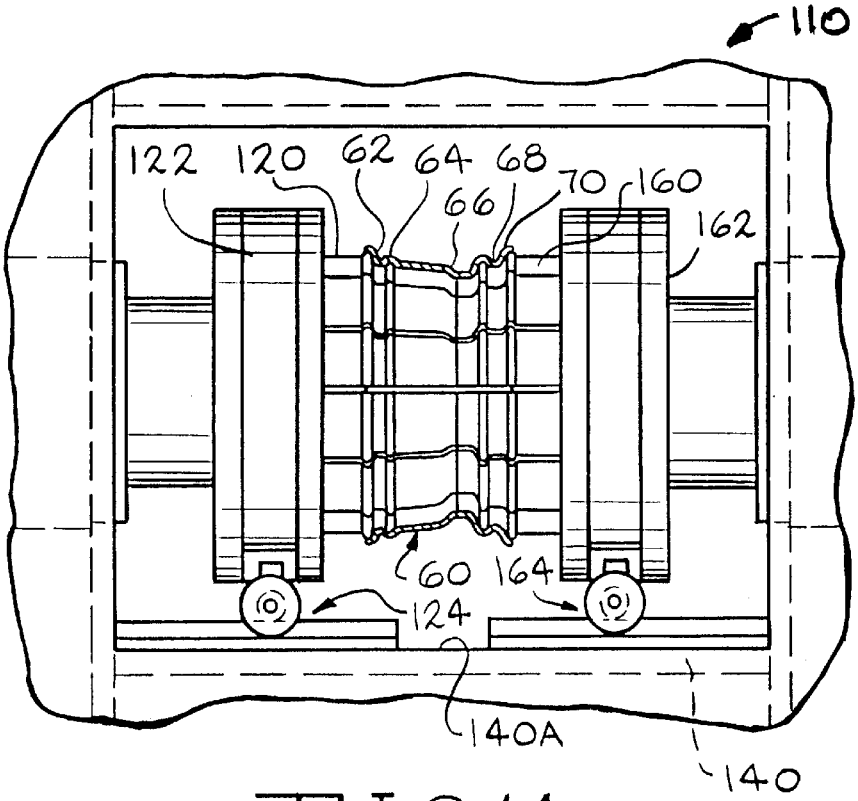
FIG. 11 is a partial elevational view similar to FIG. 10 and showing the showing the wheel rim expanding tooling apparatus in the final working position.

As shown in FIG. 8, the wheel rim expanding tooling apparatus 110 of the present invention includes an inboard wheel rim expanding tooling assembly, indicated generally at 112, and an outboard wheel rim expanding tooling assembly, indicated generally at 114. The inboard wheel rim expanding tooling assembly 112 includes an inboard expander press 120, a barrel head 122, and an inboard expander press guide support 124. As will be discussed below, the expander press guide support 124 is operative to support the outboard expander press 120 for selective movement between the retracted position shown in FIG. 10 and the extended position shown in FIGS. 9 and 11. The inboard expander press 120 and the barrel head 122 are conventional in the art. The inboard expander press 120 includes a plurality of segmented press members which are adapted to engage an inner surface of the wheel rim and expand the wheel rim to a final desired profile in a known manner.

Figure 12:
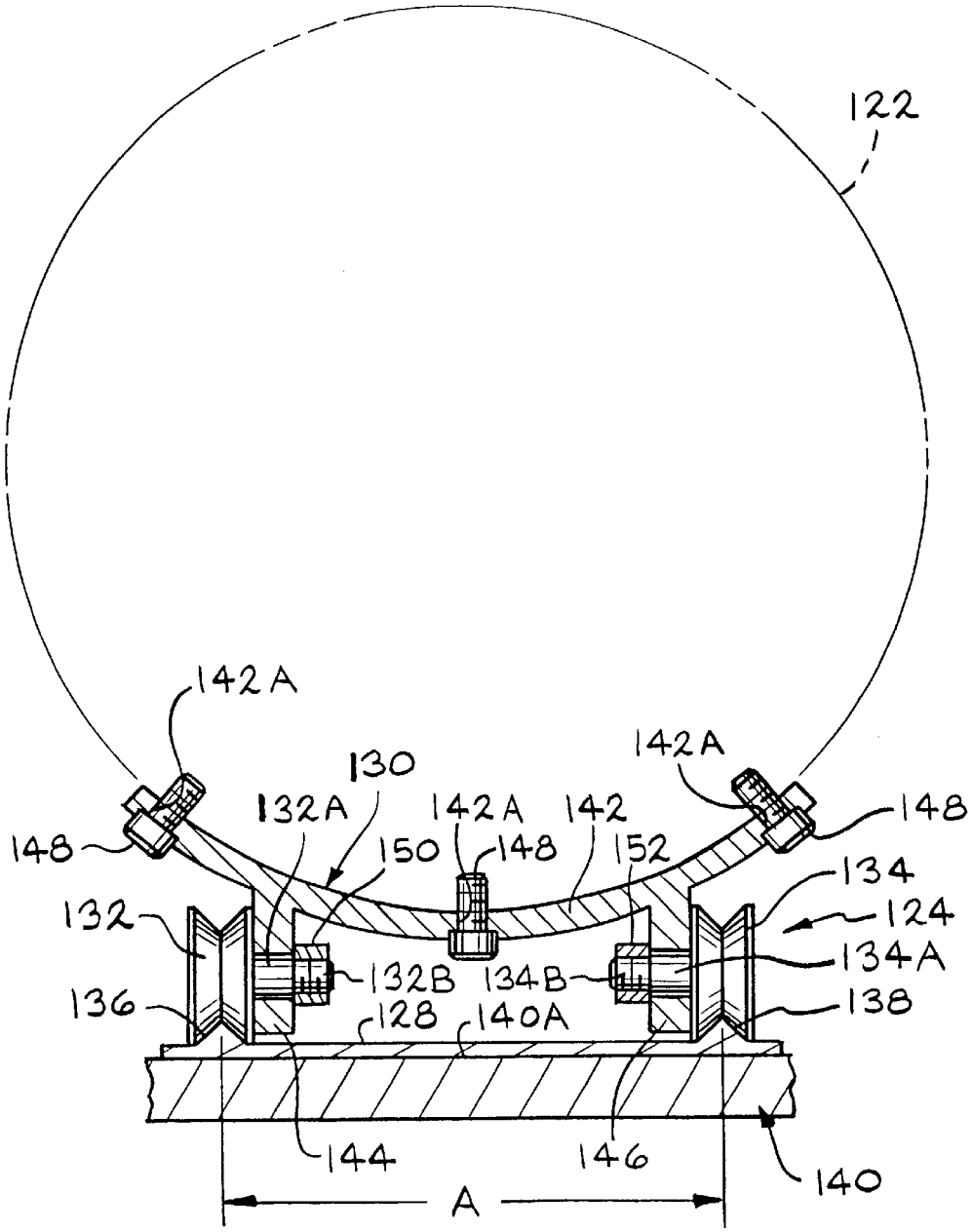
FIG. 12 is a partial cross sectional elevational view of a portion of the wheel rim expanding tooling apparatus of the present invention.

As best shown in FIG. 12, the expander press guide support 124 includes a base plate 128, a barrel head support bracket 130, and a pair of runners 132 and 134. The base plate 128 is secured or otherwise fixed to an upper surface 140A of a portion of an expander fixture 140 by a suitable means, such as for example by bolts (not shown). In the illustrated embodiment, the base plate 128 includes a pair of tracks or rails 136 and 138 which are formed integral with the base plate 128. In the illustrated embodiment, the tracks 136 and 138 have a generally inverted V-shape and are spaced apart from one another by a predetermined lateral distance A. The base plate 134 is formed from a suitable material, such as for example steel. Alternatively, the construction of the base plate 128 and/or the support tracks 136 and 138 can be other than illustrated if so desired. For example, the base plate 128 could be eliminated and the support tracks 136 and 138 could be provided. Also, the particular structure of the runners 132 and 134 and/or the support tracks 136 and 138 can be other than illustrated.

The support bracket 130 includes a main body or cradle 142 and a pair of mounting legs 144 and 146 extending therefrom. The cradle 142 is generally U-shaped and is provided with a plurality of apertures 142A formed therethrough (three of such apertures 142A shown in FIG. 12). A threaded bolt 148 extends through a respective one of the apertures 42A formed in the cradle 142 of the support bracket 130 to secure the barrel head 122 thereto. Alternatively, other suitable means can be used to secure the cradle 142, and therefore the support bracket 130, to the barrel head 122.

The legs 144 and 146 of the support bracket 130 are provided with a respective opening 144A and 146A formed therethrough. In the illustrated embodiment, an extension 132A of the runner 132 extends through the opening 144A and a nut 150 is installed on a threaded end 132B of the runner 132 to thereby secure the runner 132 to the leg 144 of the bracket 130. In a similar manner, an extension 134A of the runner 134 extends through the opening 146A and a nut 152 is installed on a threaded end 134B of the runner 134 to thereby secure the runner 134 to the leg 146 of the bracket 130. As will be discussed below, the runners 132 and 134 and the support tracks 136 and 138 cooperate to enable the inboard wheel rim expanding tooling assembly 112 to be selectively moveable between the retracted position shown in FIG. 10 and the extended position shown in FIGS. 9 and 11.

The outboard wheel rim expanding tooling assembly 114 includes an outboard expander press 160, a barrel head 162, and an outboard expander press guide support 164. As will be discussed below, the expander press guide support 164 is operative to support the outboard expander press 160 for selective movement between the retracted position shown in FIG. 10 and the extended position shown in FIGS. 9 and 11. The outboard expander press 160 and the barrel head 162 are conventional in the art. The outboard expander press 160 includes a plurality of segmented press members which are adapted to engage an inner surface of the wheel rim and expand the wheel rim to a final desired profile in a known manner. In the illustrated embodiment, the structure of the outboard expander press guide support 164 is not shown in detail but is essentially identical to the structure of the inboard expander press guide support 124 described above and illustrated in detail in FIG. 12. Alternatively, the structure of the outboard expander press guide support 164 can be different from that of the inboard expander press guide support 124 if so desired.

Figure 7:
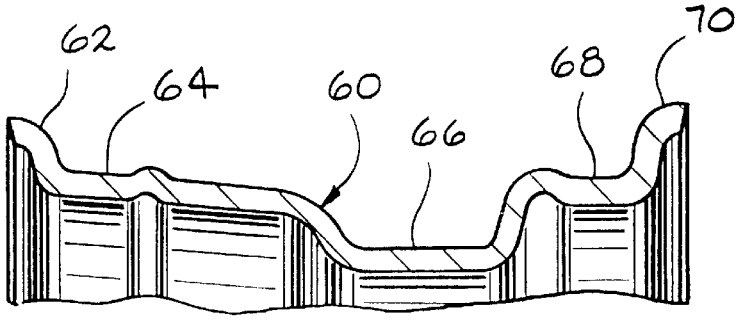
FIG. 7 is a schematic diagram of the finished wheel rim produced by an expanding operation.

As shown in FIG. 7 the "expanded" finished wheel rim 60 includes an inboard tire bead seat retaining flange 62, an inboard tire bead seat 64, a generally axially extending well 66, and an outboard tire bead seat 68, and an outboard tire bead seat retaining flange 70. In step 24, the wheel rim 60 is secured to a preformed wheel disc, indicated generally at 80 in FIG. 13, by welding to produce the finished vehicle wheel 100. As shown in FIG. 13, the wheel disc 80 includes a central mounting portion 82, an intermediate bowl-shaped portion 84, and an outer portion 86 which includes a flange 88. The wheel disc 80 can be formed from steel, aluminum, or alloys thereof depending upon the construction of the associated wheel rim 60.

Figure 12A:
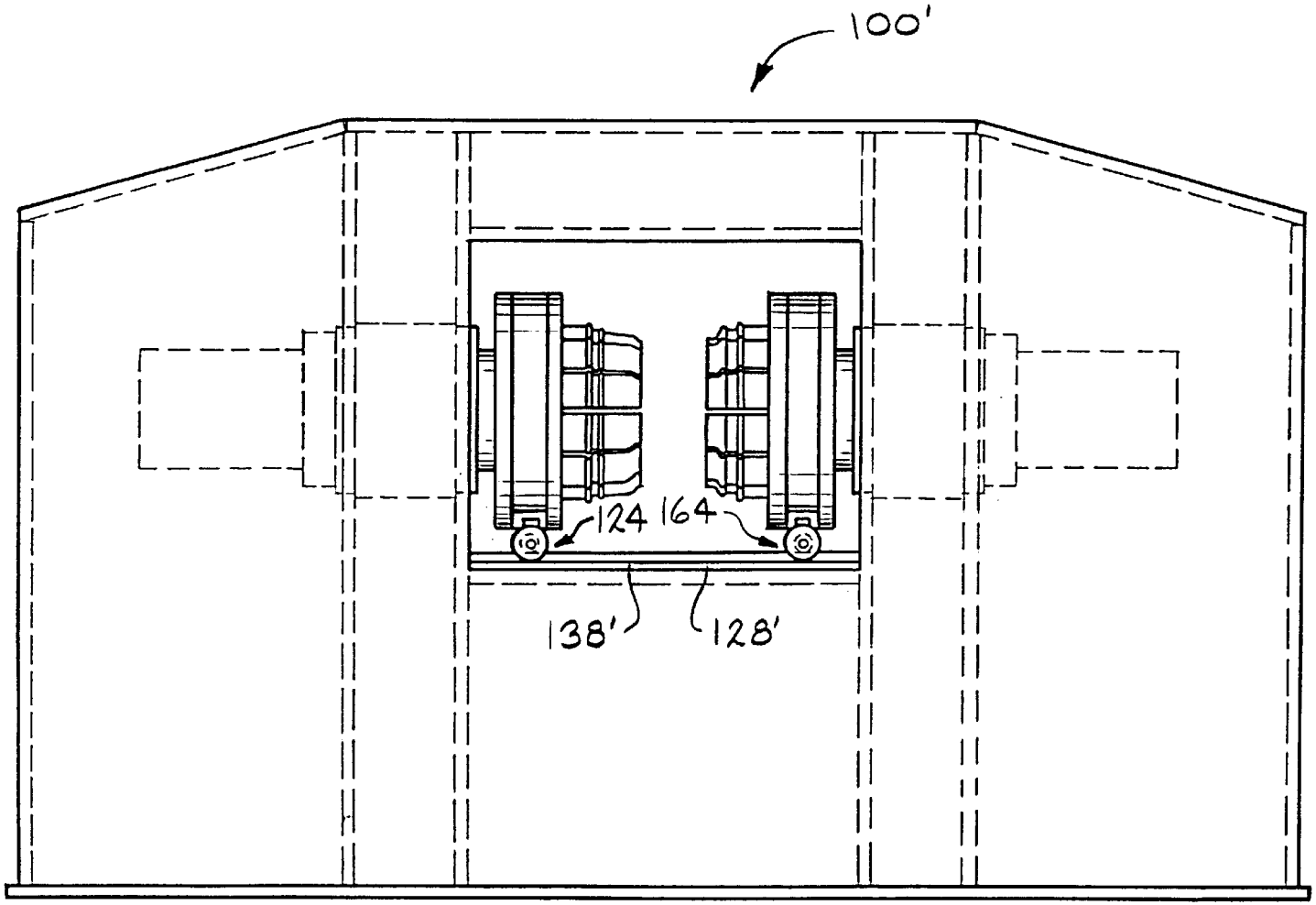
FIG. 12A is a partial elevational view of a second embodiment of a wheel rim expanding tooling apparatus in accordance with the present invention.

Referring now to FIG. 12A and using like reference numerals to refer to like parts, there is illustrated a second embodiment of a wheel rim expanding tooling apparatus, indicated generally at 100', constructed in accordance with the present invention. As shown therein, the wheel rim expanding tooling apparatus 100' is similar to the wheel rim expanding tooling apparatus 100 illustrated in FIGS. 5 through 12 except that it includes a single base plate 128' having a pair of continuous support tracks (only track 138' being shown) adapted to guide and support an inboard expander press guide support 124' and an outboard expander press guide support 164' instead of a pair of base plates 128 having separate support tracks 136 and 138 for the inboard expander press guide support 124 and the outboard expander press guide support 164.

Figure 12B:
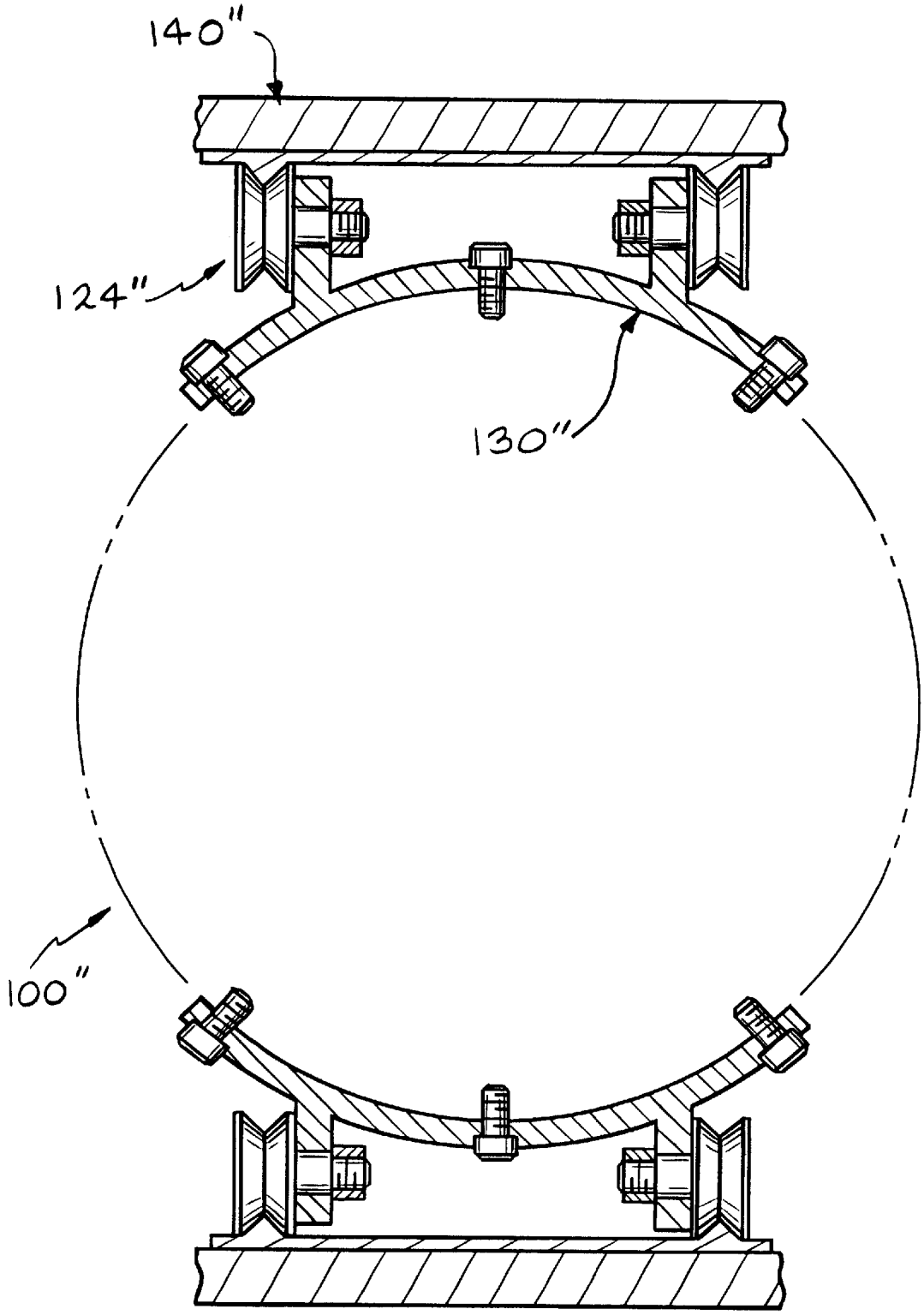
FIG. 12B is a partial cross sectional elevational view of a portion of a third embodiment of a wheel rim expanding tooling apparatus in accordance with the present invention.

Referring to FIG. 12B and using like reference numeral to refer to similar parts, there is illustrated a third embodiment of a wheel rim expanding tooling apparatus, indicated generally at 100", in accordance with the present invention. As shown therein, the wheel rim expanding tooling apparatus 100" is similar to the wheel rim expanding tooling apparatus 100 illustrated in FIGS. 5 through 12 except that in addition to the "lower" expander press guide support 124, the "lower" barrel head support bracket 130, and the "lower" expander fixture 140, it includes an "upper" expander press guide support 124", an "upper" barrel head support bracket 130", and an "upper" expander fixture 140", each of which generally corresponds to the associated "lower" apparatus members. Alternatively, the construction of the "upper" apparatus members and the "lower" apparatus members can be different from one another if so desired.

Figure 14:
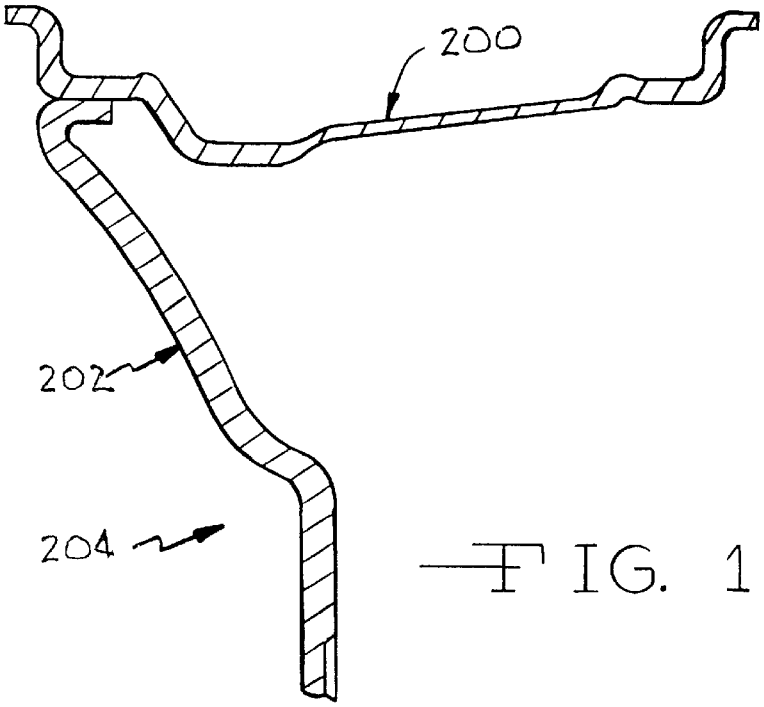
FIG. 14 is a partial sectional view of a second embodiment of a vehicle wheel produced using a wheel rim produced using the wheel rim expanding tooling apparatus in accordance with the present invention.
Figure 15:
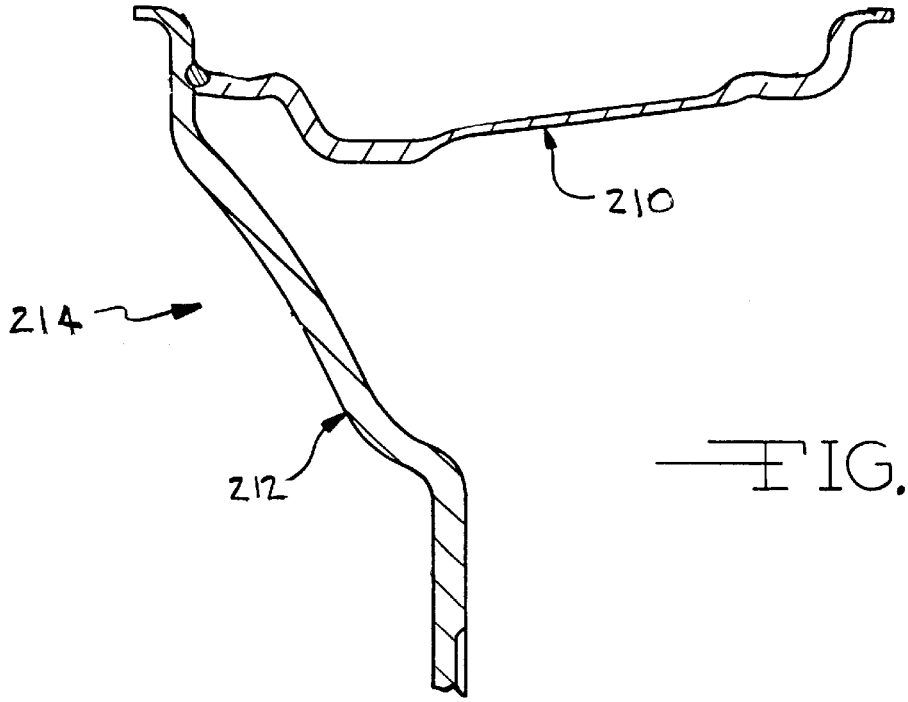
FIG. 15 is a partial sectional view of a third embodiment of a vehicle wheel produced using a wheel rim produced using the wheel rim expanding tooling apparatus in accordance with the present invention.
Figure 16:
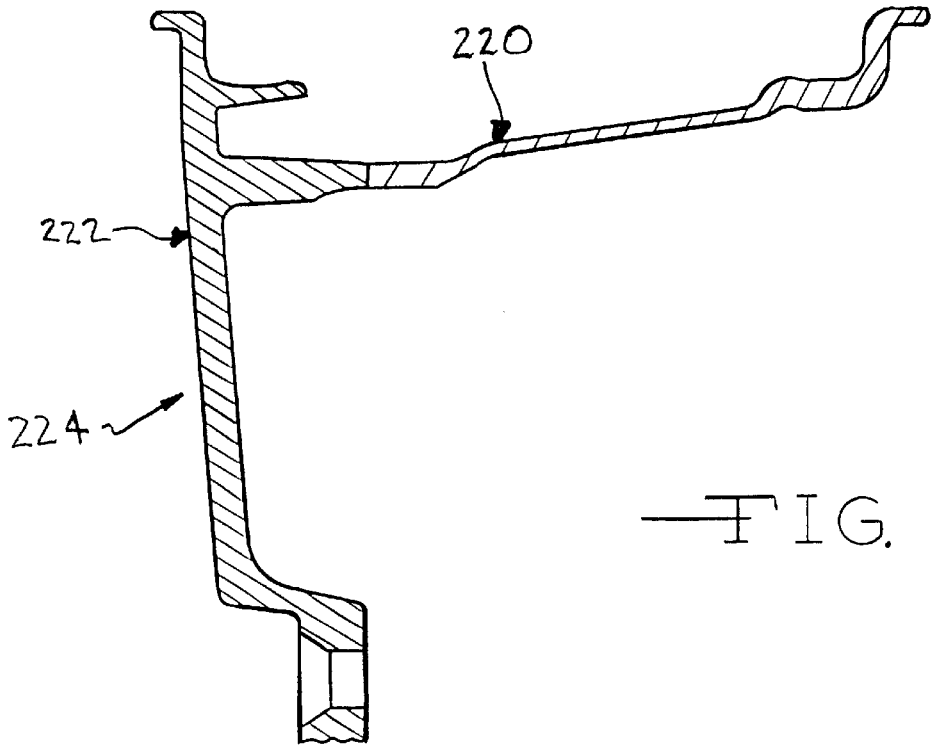
FIG. 16 is a partial sectional view of a fourth embodiment of a vehicle wheel produced using a wheel rim produced using the wheel rim expanding tooling apparatus in accordance with the present invention.

While the invention has been illustrated and described as forming a wheel rim 60 for use in a bead seat attached vehicle wheel 100, the invention can be practiced to form an associated wheel rim for use in other types of wheels. For example, as shown in FIG. 14, the invention can be practiced to produce a wheel rim 200 which is secured to a preformed wheel disc 202 to produce a "bead seat" attached vehicle wheel 204. Also, as shown in FIG. 15, the invention can be practiced to produce a "partial" wheel rim 210 which is secured to a "full face" wheel disc 212 to produce a full face vehicle wheel 214. In addition, as shown in FIG. 16, the invention can be practiced to produce a "partial" wheel rim 220 which is secured to a full face wheel disc 222 to produce a full face modular vehicle wheel 224.

One advantage of the present invention is that the wheel rim expanding tooling apparatus 100 is operative to provide a support and guidance system which keeps the inboard wheel rim expanding tooling assembly 112 and the outboard wheel rim expanding tooling assembly 114 substantially parallel to one another and with respect to an axis of the wheel rim during movement thereof throughout the expanding operation. As a result, the uniformity of the resulting wheel rim is improved.

In accordance with the provisions of the patents statues, the principle and mode of operation of this invention have been described and illustrated in its preferred embodiments. However, it must be understood that the invention may be practiced otherwise than as specifically explained and illustrated without departing from the scope or spirit of the attached claims.

What is claimed is:

1. A support and guidance apparatus for a vehicle wheel rim expanding tooling apparatus comprising:

an inboard wheel rim expanding tooling assembly and an outboard wheel rim expanding tooling apparatus, at least one of said inboard wheel rim expanding tooling assembly and said outboard wheel rim expanding tooling apparatus being guided and supported for selective movement between a retracted non-working position and an extended working position which is effective to expand a wheel rim to a desired profile by at least one press guide support member, said press guide support member including a pair of spaced apart runners and a pair of spaced apart rails, said runners having a shape which is generally complimentary to a shape of said rails so as to allow said runners to be moveable along said rails during said selective movement, wherein said at least one of said inboard wheel rim expanding tooling assembly and said outboard wheel rim expanding tooling apparatus includes a barrel head, and said press guide support member includes a support bracket including a cradle and a pair of mounting legs extending therefrom, said cradle being generally U-shaped and provided with a plurality of apertures formed therethrough adapted to receive a fastener to secure said barrel head thereto.

2. The support and guidance apparatus according to claim 1 wherein at least one of said inboard wheel rim expanding tooling assembly and said outboard wheel rim expanding tooling apparatus are guided and supported for selective movement between a retracted non-working position and an extended working position which is effective to expand a wheel rim to a desired profile by a pair of press guide support members.

3. The support and guidance apparatus according to claim 1 wherein each of said inboard wheel rim expanding tooling assembly and said outboard wheel rim expanding tooling apparatus are guided and supported for selective movement between a retracted non-working position and an extended working position which is effective to expand a wheel rim to a desired profile by a press guide support member.

4. The support and guidance apparatus according to claim 1 wherein each of said inboard wheel rim expanding tooling assembly and said outboard wheel rim expanding tooling apparatus are guided and supported for selective movement between a retracted non-working position and an extended working position which is effective to expand a wheel rim to a desired profile by a pair of press guide support members.

5. The support and guidance apparatus according to claim 1 wherein said runners have a generally hollow V-shape and said rails have a generally solid V-shape.

6. The support and guidance apparatus according to claim 1 wherein said mounting legs are provided with a respective opening formed therethrough, and each of said runners carries a fastener which extends through a respective one of said openings in said mounting legs to thereby secure said runners to said mounting legs.

7. The support and guidance apparatus according to claim 1 wherein said press guide support member includes a base plate, said base plate including integrally formed rails.

8. A wheel rim expanding tooling apparatus comprising:

an inboard wheel rim expanding tooling assembly including an inboard expander press, an inboard barrel head, and an inboard expander press guide support, said inboard expander press guide support including a base plate, an inboard barrel head support bracket, and a pair of runners, said base plate adapted to be secured to a surface of the wheel rim expanding tooling apparatus, said base plate including a pair of spaced apart rails, said inboard barrel head support bracket including a main body having a pair of spaced apart mounting legs extending therefrom, said main body defining a generally U-shaped cradle having a plurality of apertures formed therethrough and adapted to receive a fastener to thereby secure said inboard barrel head thereto, said runners being secured to said mounting legs, said runners and said rails cooperating to enable said inboard wheel rim expanding tooling assembly to be selectively moveable between a retracted non-working position and an extended working position; and an outboard wheel rim expanding tooling assembly including an outboard expander press, an outboard barrel head, and an outboard expander press guide support, said outboard expander press guide support including a base plate, an outboard barrel head support bracket, and a pair of runners, said base plate adapted to be secured to a surface of the wheel rim expanding tooling apparatus, said base plate including a pair of spaced apart rails, said outboard barrel head support bracket including a main body having a pair of spaced apart mounting legs extending therefrom, said main body defining a generally U-shaped cradle having a plurality of apertures formed therethrough and adapted to receive a fastener to thereby secure said outboard barrel head thereto, said runners being secured to said mounting legs, said runners and said rails cooperating to enable said outboard wheel rim expanding tooling assembly to be selectively moveable between a retracted non-working position and an extended working position.

9. The wheel rim expanding tooling apparatus according to claim 8 wherein at least one of said inboard wheel rim expanding tooling assembly and said outboard wheel rim expanding tooling assembly includes a pair of expander press guide supports.

10. The wheel rim expanding tooling apparatus according to claim 8 wherein said base plates of said inboard and outboard press guide support member include integrally formed rails.

11. The wheel rim expanding tooling apparatus according to claim 8 wherein said runners have a generally hollow V-shape and said rails have a generally solid V-shape.

12. The wheel rim expanding tooling apparatus according to claim 8 wherein said mounting legs are provided with a respective opening formed therethrough, and each of said runners carries a fastener which extends through a respective one of said openings in said mounting legs to thereby secure said runners to said mounting legs.

13. A wheel rim expanding tooling apparatus comprising:

an inboard wheel rim expanding tooling assembly including an inboard expander press, an inboard barrel head, and a pair of inboard expander press guide supports, each of said pair of inboard expander press guide supports including a base plate, an inboard barrel head support bracket, and a pair of runners, said base plate adapted to be secured to a surface of the wheel rim expanding tooling apparatus, said base plate including a pair of spaced apart rails, said inboard barrel head support bracket including a main body having a pair of spaced apart mounting legs extending therefrom, said main body defining a generally U-shaped cradle having a plurality of apertures formed therethrough and adapted to receive a fastener to thereby secure said inboard barrel head thereto, said runners being secured to said mounting legs, said runners and said rails cooperating to enable said inboard wheel rim expanding tooling assembly to be selectively moveable between a retracted non-working position and an extended working position; and an outboard wheel rim expanding tooling assembly including an outboard expander press, an outboard barrel head, and a pair of outboard expander press guide supports, each of said outboard expander press guide supports including a base plate, an outboard barrel head support bracket, and a pair of runners, said base plate adapted to be secured to a surface of the wheel rim expanding tooling apparatus, said base plate including a pair of spaced apart rails, said outboard barrel head support bracket including a main body having a pair of spaced apart mounting legs extending therefrom, said main body defining a generally U-shaped cradle having a plurality of apertures formed therethrough and adapted to receive a fastener to thereby secure said outboard barrel head thereto, said runners being secured to said mounting legs, said runners and said rails cooperating to enable said outboard wheel rim expanding tooling assembly to be selectively moveable between a retracted non-working position and an extended working position.

14. The wheel rim expanding tooling apparatus according to claim 13 wherein said base plates of said inboard and outboard press guide support member include integrally formed rails.

15. The wheel rim expanding tooling apparatus according to claim 13 wherein said runners have a generally hollow V-shape and said rails have a generally solid V-shape.

16. The wheel rim expanding tooling apparatus according to claim 13 wherein said mounting legs are provided with a respective opening formed therethrough, and each of said runners carries a fastener which extends through a respective one of said openings in said mounting legs to thereby secure said runners to said mounting legs.

* * * * *